US006899079B1

(12) United States Patent
Hill et al.

(10) Patent No.: US 6,899,079 B1
(45) Date of Patent: May 31, 2005

(54) ENGINE EXHAUST BRAKE

(76) Inventors: Patrick George Hill, 6800 Gold Creek Rd., Willamina, OR (US) 97396; Michael Lee Hill, 410 Weiby Ct., Silverton, OR (US) 97381

( * ) Notice: Subject to any disclaimer, the term of this patent is extended or adjusted under 35 U.S.C. 154(b) by 0 days.

(21) Appl. No.: 10/613,294

(22) Filed: Jul. 3, 2003

(51) Int. Cl.[7] ..... F02D 9/06
(52) U.S. Cl. ..... 123/323; 60/324
(58) Field of Search ..... 123/323, 65 PE, 123/65 V, 190.2, 80 BA, 80 BB, 568.14; 60/324

(56) References Cited

U.S. PATENT DOCUMENTS 5,000,131 A * 3/1991 Masuda ..... 123/323
5,372,109 A * 12/1994 Thompson et al. ..... 123/323
6,085,722 A * 7/2000 Zimmermann ..... 123/323
6,273,059 B1 * 8/2001 Wagner ..... 123/323
2001/0006057 A1 * 7/2001 Shin ..... 123/323

FOREIGN PATENT DOCUMENTS

GB 2131128 A * 6/1984 ..... 123/323

* cited by examiner

*Primary Examiner*—Willis R. Wolfe, Jr.
(74) *Attorney, Agent, or Firm*—Brian C. Trask

(57) ABSTRACT

A ball valve operable as an engine brake to resist high rpm operation of the engine on which it is installed. The ball valve has a noncontact seal and can include an aperture through a seal face to permit bypass of sufficient exhaust for operation of the engine at idle while the brake is engaged. If present, the aperture can be tuned, or sized, to provide a desired back pressure matched to a specific engine.

19 Claims, 5 Drawing Sheets

ENGINE EXHAUST BRAKE

BACKGROUND

1. Field of the Invention

This invention relates to brake systems for internal combustion engines, and particularly to devices operable to increase back-pressure in an exhaust stream discharged from such engines.

2. State of the Art

It is known to install a flow-restricting valve in an exhaust stream from an internal combustion engine to resist high rpm operation of that engine, with the valve essentially acting as a brake for the vehicle. Such valves can provide an open position for unrestricted engine operation, for example to drive the vehicle up a hill, or across level terrain. A closed, or exhaust restricting, position is used as, or to augment, the vehicle's mechanical brakes, such as when driving down an incline.

Certain United States patents document the considerable work that has been done to develop various devices operable to augment mechanical brakes for vehicles. Representative recent patents include: U.S. Pat. No. 6,305,349 to Harris, for "Sliding gate exhaust brake assembly"; U.S. Pat. No. 6,257,201 to Kajiiura et al. for "Exhaust brake"; U.S. Pat. No. 6,205,975 to Ruedin et al. for "Method and apparatus for controlling the actuation of a compression brake"; U.S. Pat. No. 6,152,853 to Banks, III for "Vehicle exhaust brake and control system"; and U.S. Pat. No. 6,062,025 to Okada et al. for "Auxiliary brake system".

It would be an advance to provide an engine exhaust break arrangement that is reliable, less complicated, and lower-cost to manufacture.

BRIEF SUMMARY OF THE INVENTION

The present invention provides an apparatus operable as a vehicle brake by increasing a back-pressure in the exhaust stream discharged from an internal combustion engine which is used to power the vehicle. An exemplary such brake can be embodied as a ball valve disposed in the exhaust pipe of a diesel engine.

One embodiment of an exhaust brake constructed according to the present invention is adapted to form a noncontact valve seal between a rotatable seal member (the ball) and a housing, across which seal a pressure drop is induced, to provide the necessary back-pressure to act as a brake. The exhaust brake includes a valve and a valve actuator assembly or mechanism. With its sealing member at a first, or break-off, position, the valve provides substantially restriction-free passage of an exhaust stream through a conduit passage through the seal member. When rotated to a second, or break-on position (with an axis of the conduit passage disposed substantially at right angles to an exhaust stream flow direction at an inlet into the valve), the valve provides an increased restriction to increase a back-pressure in the exhaust stream operable to resist high-rpm-rotation of the engine. However, at the second position, the valve desirably permits to operational rotation of the engine at an idle-speed.

In detail, an exemplary valve includes a clamshell housing defining a cavity and a pair of orthogonal passageways disposed to intersect approximately at a center of the cavity. A first housing passageway defines an inlet and an outlet for the exhaust from an engine. The inlet side of the housing has a first seal surface arranged to is circumscribe a junction between the inlet and the cavity. A second housing passageway provides interface structure to suspend and rotate a ball seal member.

A preferred embodiment of a clamshell housing includes interlocking front and rear sections adapted for assembly along an axis approximately parallel to a common axis of the inlet and outlet. Furthermore, an abutting flange surface carried by each of the front and rear section provides a datum from which axially to space apart a housing inlet seal surface from a housing outlet seal surface. Desirably, a male cylindrical lip carried by one of the front section and rear section is received in mating structure carried in the other cooperating section vertically to align the housing inlet seal surface and the housing outlet seal surface with respect to seal surfaces carried by the ball.

A ball sealing member is disposed for rotation in the cavity contained in the clamshell housing. The ball is supported between first and second stub axles that are disposed for rotation about an axis in common with the second housing passageway. The ball can be positioned to orient a ball seal surface in non-contacting harmony with the seal surface carried at a discharge opening from the housing inlet conduit. Desirably, the ball carries symmetric seal areas adapted simultaneously to interface with inlet and outlet housing seal surfaces.

In certain embodiments of a ball, a ball seal face, circumscribed by a seal surface, carries an aperture that can be placed into fluid communication with a valve discharge conduit. If present, the aperture is sized in harmony with a bypass area (such as an area disposed between a forward ball seal surface and an inlet housing seal surface), to permit operational rotation of the engine at an idle-speed when the seal member is at a break-on position. The aperture is generally sized to accommodate a particular size engine, and in some cases is bored larger as desired. In other cases, the seal face is adapted to interface with an assortment of removable plugs, each plug providing an aperture of a different size.

In a preferred valve embodiment, the second passageway through the housing carries bearing caps to rotatably suspend the ball sealing member. One bearing cap is arranged as a thimble housing with a dead-end plug to resist passage of exhaust through that end. An opposite end of the second passageway caries an open housing adapted to receive passage therethrough of an axle shaft, with a high temperature o-ring seal being disposed to resist bypass of exhaust along the axle shaft and through the opposite end.

A typical bearing arrangement includes a first bushing installed in an interference fit in the thimble housing; a second bushing installed in an interference fit in the open housing; with a first stub axle holding a third bushing installed in an interference fit; and the second stub axle holding a fourth bushing installed in an interference fit. Slip-fit rotatable bearings are formed on assembly between the first and third bushings, and the second and fourth bushings. A high-temperature anti-seize lubricant is added to lubricate the bearings. Thrust bearings include a first thrust washer disposed between a body of the ball and the first bushing and a second thrust washer disposed between a body of the ball and the second bushing. Desirably, the thrust washers are spaced apart in a valve such that an installed ball seal member is permitted an axial play of about 0.035 inches between the first thrust washer and the second thrust washer when measured at an ambient temperature.

An operable bearing arrangement is formed when each of the first, second, third, and fourth bushing is made of hardened steel. A preferred slip fit is formed by a difference in diameter, between an installed inner bushing and an installed outer bushing, of between about 0.002 inches to about 0.005 inches. It is desirable for the housing and seal member to be formed as metal components having similar coefficients of thermal expansion. Furthermore it is preferred for stub axles to be formed as an integral part of the ball to resist axle deflection and misalignment problems.

A pressure drop across a seal area can be augmented by an exhaust deflector disposed to protrude inward radially around a discharge end of the inlet conduit. The exhaust deflector is operable to cause an eddy effective to choke the flow of exhaust through the noncontacting seal bypass area. Seal areas desirably are left proud by adding a relief cut. Desirably, a breakover edge is disposed between a seal surface and a relief area formed in the ball, with the edge being operable to scrape a build-up of exhaust particles from the seal surface to clean the valve.

The currently preferred valve is sized to accommodate a range of commercially available engines. The inlet conduit has an inside diameter of about 3.75 inches, and can be coupled to larger or smaller exhaust pipes with expansion or contraction couplings. The housing seal surfaces are formed as a section of a first sphere having a first diameter of about 5.5 inches, and the ball seal surface comprises a section of a second sphere having a second diameter smaller than the first diameter by about 0.04 inches.

It is currently preferred to provide an occludable conduit disposed through a wall of the inlet. Such a penetration provides access for a technician to measure a back-pressure of the exhaust after a valve is installed onto a vehicle. Of course, the brake includes a linkage system arranged to rotate the seal member between a break-off and a break-on position.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENT

Figure 1:
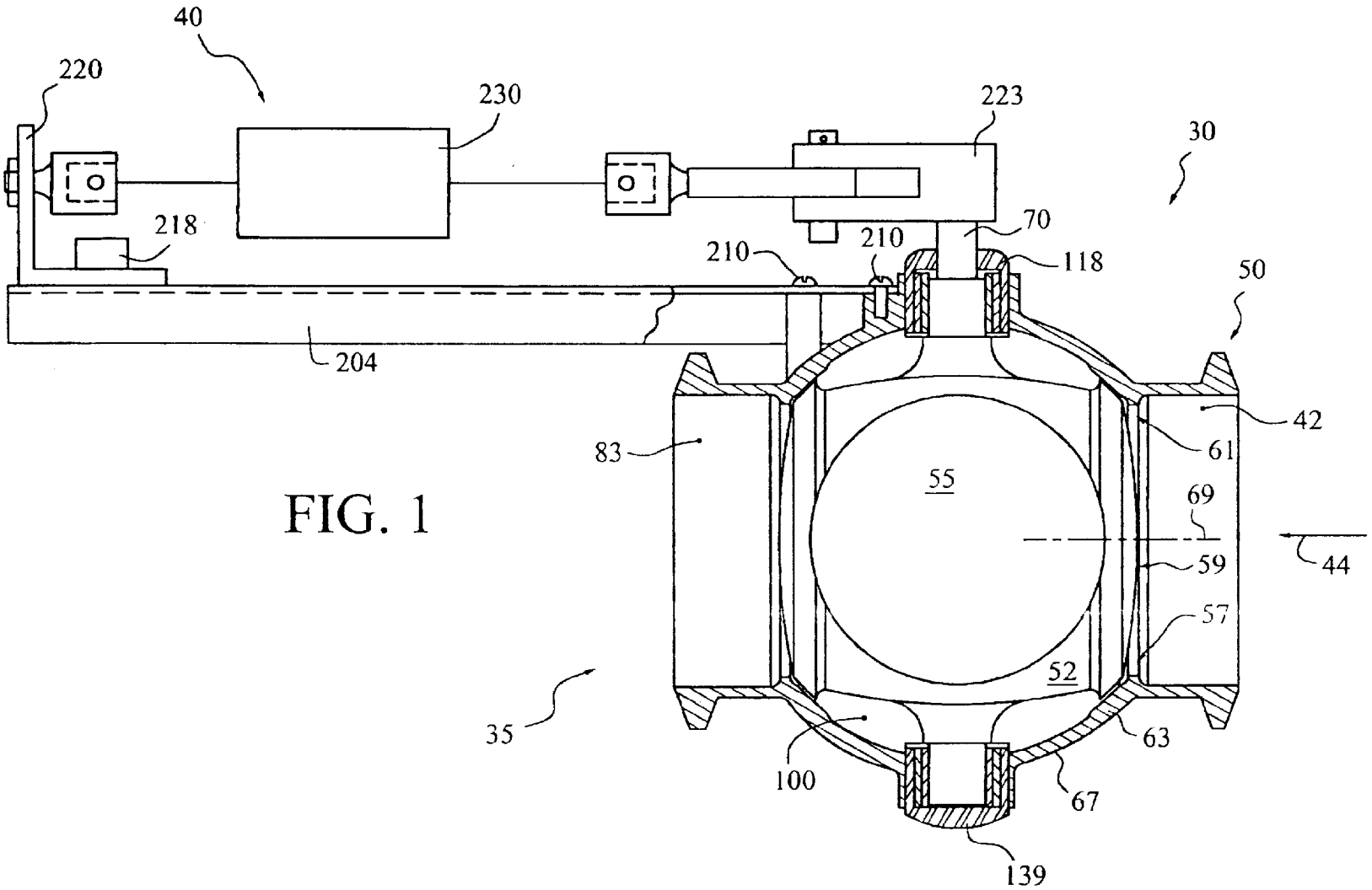
FIG. 1 is a plan view in elevation, substantially in cross-section, of a currently preferred assembled embodiment of an exhaust brake according to the invention.

As illustrated in FIG. 1, a preferred embodiment of an exhaust brake, generally indicated at 30, includes a ball valve, generally indicated at 35, and an actuator mechanism, generally indicated at 40. Ball valve 35 is adapted at an inlet 42 to receive an enclosed exhaust stream 44 from an internal combustion engine (not illustrated). The present invention can be used with any internal combustion engine. However, it currently is preferred to use the exhaust brake 30 with diesel powered engines, due to their higher pressure operating parameters, compared to gasoline powered engines.

Attach structure, generally indicated at 50, is provided to form a fluid-tight seal between inlet conduit section 42 and an exhaust pipe from the engine. The preferred embodiment is sized to accommodate most diesel engines, which have nominal exhaust pipe diameters between about 3 and about 4 inches, or so. The inside diameter of an exemplary conduit 42 is about 3.75 inches. Reducing and expanding couplings (not illustrated) can be employed to fit the valve 35 to an increased range of exhaust pipe diameters, as required. The valve 35 can also be scaled up, or down, in size. Desirably, the joints formed during assembly and installation of a valve 35 can resist an internal pressure greater than that deliverable from the engine itself.

Attach structure 50 can include any arrangement of structure operable to connect valve 35 to an exhaust pipe, including the illustrated V-flange adapted for reception in a V-band coupling. In certain cases, a gasket may also be included in the joint to increase seal effectiveness. One commercially available V-band coupling operable to form a joint between a valve 35 and an exhaust pipe is model No. 35805/250-0640 sold by CLAMPCO, of 1743 Wall Road, Wadsworth Ohio 44281. Alternative attach structure 50 can include direct-bolted flanges and welding of structure associated with an inlet 42 to an exhaust pipe.

The valve 35 illustrated in FIG. 1 has its valve seal member 52 oriented in a brake position. At that brake position, conduit 55, passing completely through seal member 52, is oriented substantially perpendicular to the direction of flow of exhaust 44 at the inlet conduit 42. Conduit 55 is sized to have a diameter in correspondence with a diameter of inlet 42. Conduit 55 participates in forming a first passageway through the valve 35 (when an axis of the conduit 55 is aligned with an axis of the inlet 42, at a valve open position), which permits substantially unrestricted passage of exhaust 44 through the valve 35. A discharge end, generally 57, of inlet 42 is substantially occluded by seal face 59 when seal member 52 is in the closed, or brake, position.

At a fully-closed brake orientation of valve 35, exhaust 44 is routed through a bypass area sized to provide sufficiently low back-pressure to permit operation of the engine at an idle speed. However, the bypass area desirably is small enough to provide an increased back-pressure operable to resist high rpm operation of the engine. At higher rpm, the closed valve 35 illustrated in FIG. 1 acts increasingly as a brake to resist engine rotation. Because the valve operates in the compressed flow regime, where a choked-flow condition through the bypass area causes an enhanced pressure drop, the valve is fairly accommodating to engines of different displacement size and idle rpm. Furthermore, as detailed lower, a bypass area can be modified to accommodate increased exhaust flow, if required.

The bypass area typically includes a space formed by a first non-contact gap, generally indicated at 61, located around a circumference between seal member 52 and inlet side 63 of clamshell housing 67. The bypass area can also include an optional tuning port or passageway. One such passageway is indicated by centerline 69 in FIG. 1, representative of a hole or aperture that may, in certain cases, be provided through face 59 of seal member 52. In some cases, a continuation of the passageway indicated by line 69 may continue entirely through the sealing member 52. Alternative passages, through other portions of a valve 35, may be provided in some cases to increase a total bypass area.

A number of actuator mechanisms 40 are operable, and must simply be able to rotate the seal member 52 by about 90 degrees. Actuators 40 within contemplation include the illustrated linear actuator assembly, which can include a solenoid operated device, or a motor powered linear actuator such as commercially available ElectroMechanical Actuator, model No. 6509K81 available in the McMaster-Carr catalog. A simple mechanical linkage may be provided as one alternative for direct manual operation of the valve 35 by the driver. An operable actuator system 40 converts rotary motion of a motor shaft into rotary motion of the seal member 52. One convenient and compact such arrangement pairs a motor driving a worm gear with a worm-driven gear affixed to axle 70. One 12 Volt motor operable in such a system is available as part No. PN 224-1105, sold by AM Motor International having a website address of http://www.amequipment.com. It is desirable for the actuator and its associated linkage to be compact, or low-profile, to fit into available space in the exhaust pipe route. It is also preferred to provide a convenient control system to operate the actuator system 40, such as a push button or toggle switch, that can be installed with minimal intrusion inside a vehicle occupant compartment.

One advantage provided by actuator mechanisms having fine control of rotational displacement of the seal member 52, such as certain motor powered actuators, is the ability they have to provide a variable amount of braking force, as desired. For example, in driving down a hill of little angle, the brake 30 may be only partially engaged by rotating seal member 52 to a less than 90 degree angle from fully open. At such a partially closed position, additional bypass area provided by an incompletely blocked conduit 55 permits exhaust 44 to flow through the valve 35 with a lower back-pressure than at a fully closed position. If the hill steepens, the valve 35 can be simply closed by an additional corresponding increment until a fully closed position is reached, providing maximum exhaust brake power. It is within contemplation for an electronic feed-back loop to control an actuator mechanism to adjust the brake 30 in conjunction with a speed-control system of the vehicle.

With reference to FIGS. 1 through 5, one preferred construction of the valve clamshell housing 67 will now be discussed. For purpose of simplifying this disclosure, it should be noted that the relational aspects of the various components will generally be described from the perspective of a typical installation on a vehicle. As such the inlet, which sometimes may be referred to as the front of the valve, is connected to an exhaust pipe leading to the engine, and the outlet, or back end, is connected opening to the vehicle's tail pipe. While a top and bottom orientation is illustrated in certain FIGs. and described herein, rotation about a valve centerline of an installed valve from the described orientation is permitted.

Valve housing 67 typically is made as a two-piece clamshell housing that includes an inlet side 63 and an outlet side 73, and when assembled, looks substantially like a sphere pierced by a conduit section. Inlet side 63 includes conduit wall 75 forming inlet bore 42 adapted to receive pressurized exhaust. Pressure tap port 76 desirably is provided to permit gas pressure of the exhaust to be measured at engine idle subsequent to installation of the brake 30 onto a vehicle. Port 76 can conveniently be fashioned as a threaded hole though wall 75, and in preferred embodiments is a ⅛ inch NPT port. A brass plug is provided to seal the port 76 after the installation and verification is complete. One or more port 76 can be located as desired, spaced around the circumference of wall 75, to provide convenient access for a technician to test the back-pressure provided by an installed valve 35.

Structural provisions are made to resist improper escape of pressurized exhaust from inside the exhaust system of the vehicle. Some sort of attach structure 50 is associated with an inlet and an outlet of the valve 35 to interface the valve to the exhaust pipe. In the illustrated embodiment, attach structure 50 is a V-flange arrangement associated with inlet conduit 42 of the valve to form a pressure resistant connection with the exhaust pipe from the engine. Certain embodiments, such as the illustrated embodiment, may lack a pilot lip typically associated with such flange structure, to better accommodate an amount of misalignment resulting from an installation location necessarily close to a bend in the exhaust pipe.

Once the exhaust 44 enters a valve 35, provisions are made to ensure that the exhaust 44 leaves only by way of the exhaust pipe. An abutting flange surface 77 is formed in inlet housing 63, at a convenient location near a midplane of the spherical portion of an assembled housing 67, and is adapted to mate with outlet side 73 to seal the clamshell housing from exhaust leaks. A female cylindrical shelf 79 desirably is provided on one of the halves 63, 73, as an alignment aid for valve seal structure and can provide an additional sealing element to assist in exhaust containment. The cooperating housing desirably carries a male protruding cylinder 80 adapted for reception in female cutout portion 79.

Structure is provided in housing 63, in harmony with housing 73, to form a conduit or passageway 81 arranged to support the sealing member 52 for rotation. For convenience in both design and manufacturing, an axis of conduit 81 is generally disposed orthogonally from an axis of the conduit that includes inlet conduit portion 42 and outlet conduit portion 83.

Figure 3:
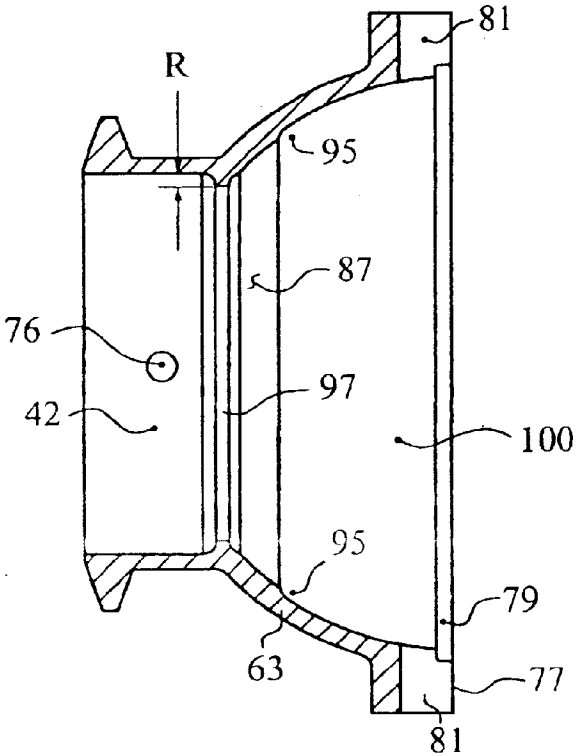
FIG. 3 is a cross-section view through the housing portion illustrated in FIG. 2, taken along section 3—3, and looking in the direction of the arrows.
Figure 2:
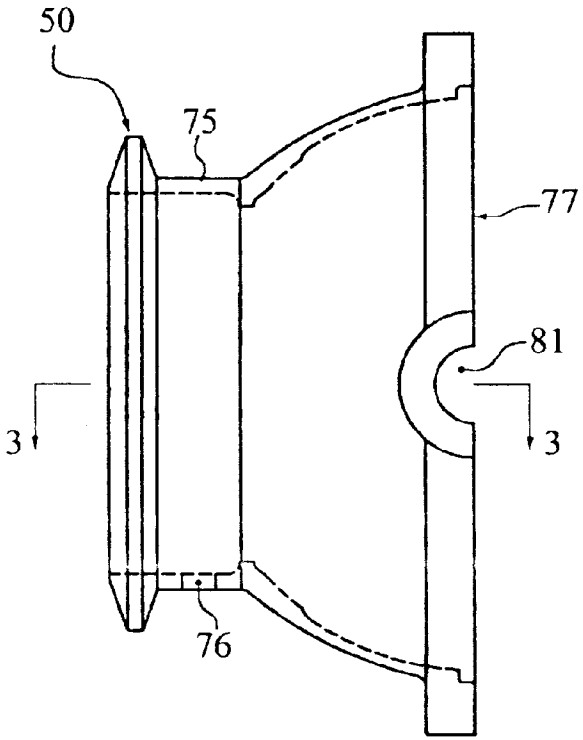
FIG. 2 is a top view of an inlet portion of a clamshell housing for the valve illustrated in FIG. 1.
Figure 5:
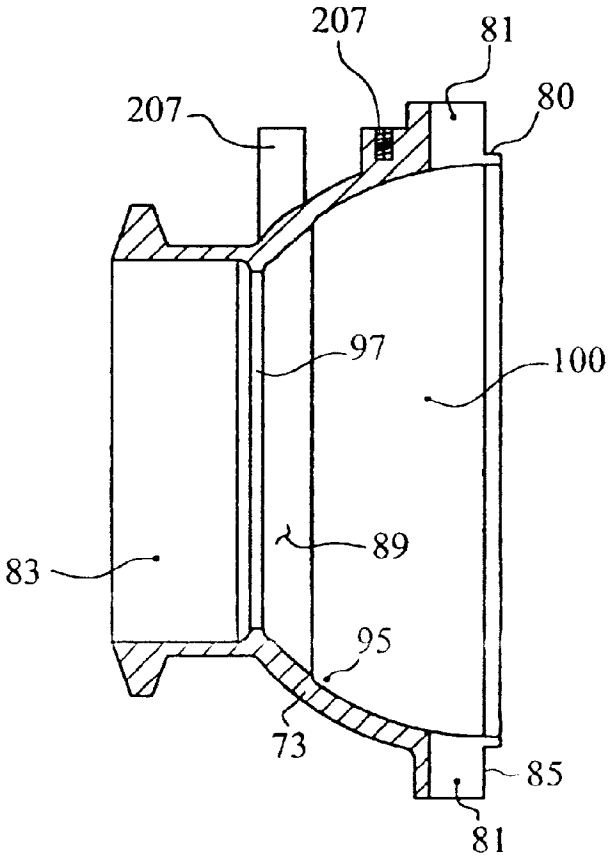
FIG. 5 is a cross-section view through the housing portion illustrated in FIG. 4, taken along section 5—5, and looking in the direction of the arrows.
Figure 4:
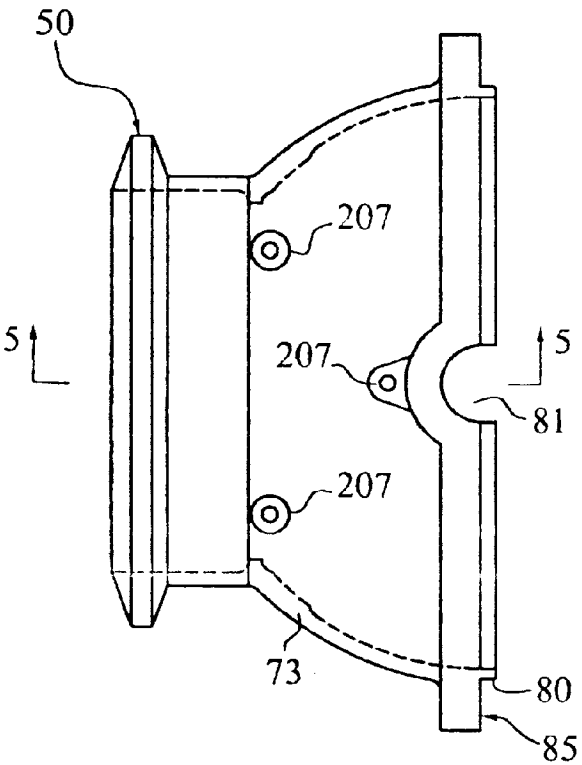
FIG. 4 is a top view of an outlet portion of a clamshell housing for the valve illustrated in FIG. 1.

Flange surface 77 abuts with flange surface 85 carried by outlet side 73 during assembly of a housing 67. With particular reference to FIGS. 3 and 5, abutting flange surfaces 77, 85 provide a convenient datum from which to space front seal surface 87 and rear seal surface 89 apart along an axis of the valve 35. Flange surface 77 is typically held in contact with flange surface 85 by fasteners arranged in a pattern around the circumference of a bolt circle. In the present embodiment, a fastener pattern incorporates six threaded fasteners and two steel rivet pins at equal spacing. The rivets are installed 180 degrees apart to resist tampering and to avoid warrantee issues. A pin is placed in a slip fit through one side 63, 73, and in a press-fit in the cooperating side 73, 63. The pin serves to maintain alignment of the inlet and outlet sides from machining through assembly.

Desirably, front seal surface 87 and rear seal surface 89 are substantially the same size and shape to provide a balancing force on a seal member 52 to assist in opening and closing a valve 35. A currently preferred front seal surface 87 is arranged as a section of a spherical surface, arranged as a torus circumscribing a perimeter of inlet conduit 42. It is also preferred for a size of a seal width, generally indicated by arrow W, to be in rough correspondence between seal surface 87 and a cooperating seal surface 91, carried by rotating member 52 (see FIG. 6). Seal surface 91 circumscribes a perimeter of face 59.

To improve resistance to forming a structural interference, resulting from heat-induced deflection between a seal on member 52 and a housing 63 or 73, a relief area or cut 93 desirably is formed on seal member 52 so that seal surface 91 is left proud. A similar relief area or cut 95 desirably is created in housings 63, 73, to leave seal surfaces 87, 89 proud. The relief cut 9S simply increases the volume of cavity 100 in which to receive ball seal member 52. The relief cut 93 desirably forms a breakover edge, such as illustrated edge 96, operable to scrape carbon build-up from a valve 35, to provide a self-cleaning capability to a valve 35.

The valve 35 is used in a high temperature environment, to control gas that is of variable temperature, and at a range of pressures. The valve is installed for service in a regime of compressed-gas flow. As such, a description of the exhaust flow is not describable using equations operable on an ideal gas. In the compressed-gas regime, a pressure drop, across seal elements such as 87 and 91, can be significantly augmented by a deflector rim 97 that is carried at a discharge end 57 of inlet conduit 42 adjacent to the gas seal area 61. Deflector rim 97 adds a radial component of velocity to gas flowing near the wall 75. The exhaust gas 44 near the entrance to gap 61 experiences an eddie, which chokes flow through the gap 61. Such a deflector rim 97 is an important aspect of certain valves 35 manufactured according to principles of the invention.

It has been determined that, in a valve constructed as illustrated valve 35 having an inlet conduit 42 with an inside diameter of 3.75 inches; a ball diameter DB of about 5.5 inches; a nominal seal gap 61 of about 0.02 inches at room-temperature; a rim 97 having the conformation illustrated in FIG. 3, and a radial projecting height of about 118 inches (indicated as distance R in FIG. 3); is effective to augment the pressure drop across seal surfaces 87, 91 comfortably to within operable specifications.

A representative valve, constructed as illustrated with housing 67 and seal element 52 being sand-cast and final machined 356-T6 Aluminum and having the dimensions recited in the previous paragraph, produces a back pressure, as measured through port 76, of about 12 psig at idle for a Ford F350 diesel engine having an engine displacement of 7.3 liters, and an idle speed of 700 rpm. That same valve/engine combination produces 35 psig at 2300 rpm, and 40 psig at 3000 rpm, when the valve is oriented to a brake mode. Without rim 97, the back-pressure at idle, for a similarly dimensioned valve in combination with the same engine, would be only about 4 psig at idle, and perhaps 31 psig at 3,300 rpm. The representative valve, when placed into a Dodge Cummings engine with a displacement of 5.9 liters, produced about 12 psig at an idle speed of 700 rpm, and 60 psig at 3,000 rpm.

Figure 6:
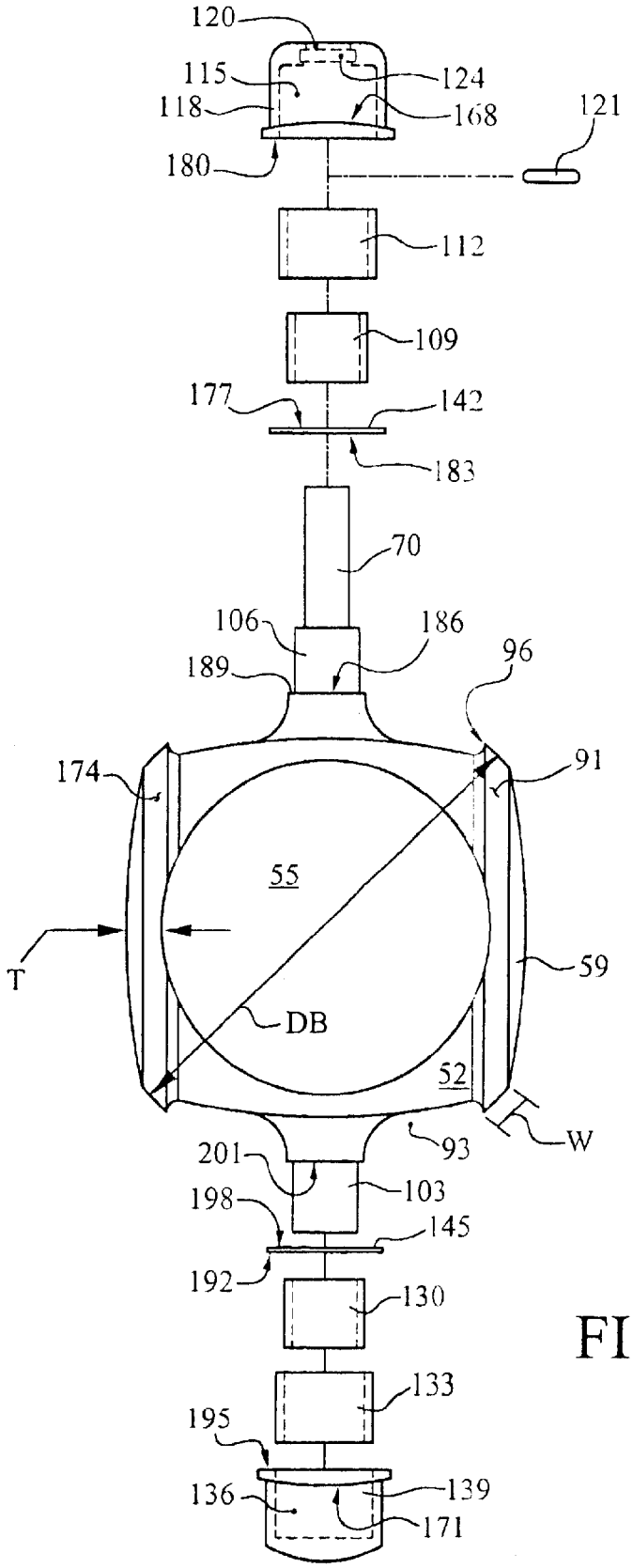
FIG. 6 is an exploded assembly view of a ball sealing member of the valve illustrated in FIG. 1.

FIG. 6. illustrates a seal member 52 and its support structure in an exploded plan view in elevation. While seal member 52 is sometimes referred to as a ball, it actually looks more like a cube suspended between stub axles 70 and 103. It currently is preferred to manufacture seal member 52 having integral stub axles 70 and 103. Maintaining alignment of the stub axles is important to resist formation of rubs, or structural interferences. A prototype valve, made from steel, had separate stub axles attached to a ball center and demonstrated alignment problems. One way to reduce such problems is to integrate the axles and seal member. In the preferred embodiment, the axles 70 and 130 are machined to final dimensions from a single casting billet, which also includes the seal member 52. Integral axles are better able to resist bending loads caused by blocking the flow of exhaust 44.

The top stub axle section 106 is journalled in a bearing assembly that includes inner bushing 109, and outer bushing 112. Inner bushing 109 typically is shrink-fit onto axle portion 106, and outer bushing 112 typically is press-fit into bore 115 passing through open housing 118. An interference of about 0.001 inch between a bushing and its foundation structure is operable. A workable clearance between inner and outer bushings has been determined to be in the range of about 0.002 inches to about 0.005 inches, with a most preferred range of between about 0.003 to about 0.004 inches.

It has been determined that a high-strength steel, such as commercially available hardened steel drill bushings, is a good material for use in making bushings. Considerable experimentation was done to find an acceptable bearing arrangement. Aluminum-on-Aluminum galls too readily; same with Brass. Most plastics cannot withstand the high temperature service environment, and suffer material degradation and instability. A nylon bushing system failed after only 8 hours, and a material sold under the trade name "Rulon J" was ruled out for its instability after only 30 hours on a testbed vehicle. Importantly, a high temperature anti-seize lubricant is applied to the rotating joint areas during assembly of a valve 35. One operable lubricant is sold by the Loctite Corporation, having a business address of Rocky Hill, Conn. 06067, under the trade name of NEVER-SEIZE, and is a Nickel-based anti-seize lubricant with an operating temperature of up to 2,400 degrees Farenheight.

Bearing cap 118 is regarded as an open housing, because bores 115 and 120 passes completely through the housing 118 to permit protrusion of axle portion 70. A flow path, such as bore 120, desirably is sealed to resist escape of exhaust 44 through housing 118. In the currently preferred embodiment, a high-temperature tolerant O-ring 121 is received in groove 124 to form a gas-resistant seal with the axle 70.

The bottom stub axle section 103 is journalled in a bearing assembly that includes inner bushing 130, and outer bushing 133. Inner bushing 130 typically is shrink-fit onto axle portion 103, and outer bushing 133 typically is press-fit into blind bore 136 in thimble housing 139, which may sometimes also be referred to as bottom bearing cap 139. Tolerances, clearances, and materials of construction are usually the same for top and bottom rotating joints.

An elevation of sealing member 52 inside cavity 100 can be controlled by use of thrust washers or shims, such as top thrust washer 142 and bottom thrust washer 145. It is important to control the elevation of sealing member 52 inside housing 67 to orient seal surface 91 effectively with respect to seal surface 87, and to resist formation of a structural interference between rotating and nonrotating components that would interfere with smooth operation of valve 35.

The upper, open bearing cap 118 has a contoured surface 168 that is adapted to interface with a machined surface in housing 67, and resists displacement of the bearing cap 118 from confinement in bore 81 formed between front and rear housing sections 63, 73 respectively. Lower bearing cap 139 has a similar surface 171. The bearing caps 118, 139 can be received in snug relation in bore 81 to resist escape of exhaust gas 44 from within the cavity 100. A cooperating fit between the housing 67 and surfaces 168, 171 may also increase effectiveness of a gas seal to reduce unwanted emissions. In certain cases, a gasket sealant may also be applied. In any event, it is currently preferred to stake the bearing caps 118, 139 in an installed position, with a fixed spacing between bearing caps, along an axis of bore 81 by inserting roll pins through blind apertures passing through a wall at respective ends of bore 81 and partially through a wall of each bearing cap.

Thrust washers 142, 145 are used to adjust a vertical position of ball 52 seal surfaces 91, 174 with respect to the housing seal surfaces 87, 89. Top surface 177 of washer 142 bears on contact surface 180 of bearing cap 118. Bottom surface 183 of washer 142 bears on top contact surface 186 of ball 52. The surface 186 is formed at an inboard edge of bearing stub axle portion 106 by shoulder 189 circumscribing the axis of that axle. In similar fashion, bottom surface 192 of washer 145 bears on contact surface 195 of bearing cap 139. Top surface 198 of washer 145 bears on bottom contact surface 201 of ball 52.

The thickness of each thrust washer 142, 145 can be adjusted to change the relative elevation of ball 52 and amount of end-play. It is currently preferred to provide a 0.035 inch travel between maximum end-positions for an installed ball 52, when measured at room temperature. Furthermore, it is preferred that at a "low" position, the ball 52 just clears the seal surfaces of the housing, and therefore, at a maximum "high" position, a small rub may occur at room temperature. Gravity tends to urge the ball 52 toward the "low" position, and the end-play of 0.035 inches accommodates thermal expansion of the ball 52 due to rapid changes in exhaust temperature. In the preferred embodiment, the thrust washers are made from stainless steel, with washer 142 having a thickness of 0.031 inches, and washer 145 having a thickness of 0.025 inches.

Even with the accommodation for expansion of ball 52 provided from an end-play allowance, it has been determined that deformation of a ball 52 can still occur if a sufficiently fast and large temperature change is imposed on a ball 52, and section properties of the ball 52 are out of balance. It is known that the ball 52 and housing are each changing in size throughout the various cycles between breaking, coasting, and cruising on flat-land travel. Exhaust temperature changes considerably between throttle-down, and throttle-off modes. Rapid temperature fluctuations in the ball 52 occur because the ball 52 receives heat input from the exhaust 44, but cannot effectively loose heat, except to the exhaust 44 and a colder housing 67, due to ball 52 being encased in housing 67. Housing 67, on the other hand, can loose heat to the environment by radiation and convection. Therefore, it is known that the ball 52 is constantly changing in size relative to the housing 67.

It is important the ball member 52 is structured to maintain a stable shape during its expansion and contraction. For example, in the currently preferred seal member 52, a minimum average wall thickness, indicated at T in FIG. 6, is about ½ inches. A dome effect is generally maintained on the seal face 59 to bring up the section thickness. If the wall thickness T is formed significantly thinner, say about ¼ inches or less, a danger exists that the ball will thermally deform into an egg-shape, and cause a structural interference with a seal area.

It is preferred for the ball member 52 and housing 67 to be made from the same material, or at least of materials having substantially the same thermal expansion characteristics. While cast iron and steel are also workable materials, it currently is preferred to use Aluminum. Aluminum has sufficient strength, and offers lower weight and reduced machining costs. Either sand or die casting is operable, with sand casting being currently used. It alternatively is within contemplation for a plurality of materials to be associated with even the housing 67. For example, a steel or cast iron liner-sleeve carrying deflector rim structure 97 can be press-fit into reception in an Aluminum inlet conduit 42, and/or an outlet conduit 83.

Figure 8:
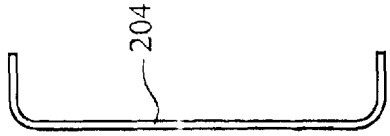
FIG. 8 is an end view of the bracket illustrated in FIG. 7.
Figure 7:
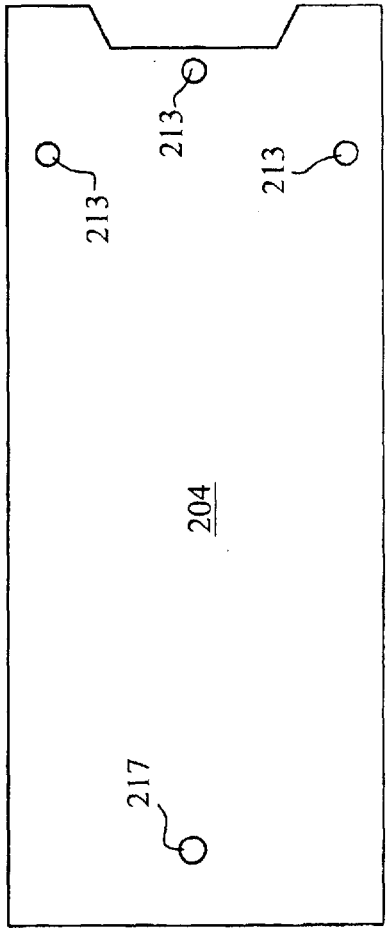
FIG. 7 is a top view of the actuator mounting bracket illustrated in FIG. 1.
Figure 9:
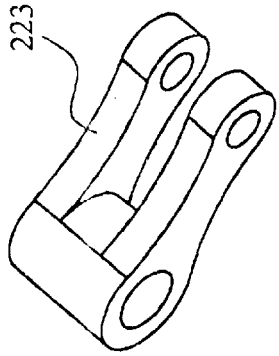
FIG. 9 is an isometric view of a portion of a portion of the actuator linkage system used in the embodiment illustrated in FIG. 1.

With reference now to FIGS. 1, 7, and 8, a foundation plate 204 for structure related to the actuator 40 conveniently can be cantilevered from the housing 67. Plate 204 can be made from any operable material, such as Aluminum or steel. Plate 204 provides a solid foundation from which to couple an actuator 40 with a valve 35. Illustrated plate 204 is cantilevered from support pillars 207 (see FIGS. 4, 5), and is held in position by a plurality of fasteners 210. Fasteners 210 pass through apertures 213. Aperture 217 is provided for a low-clearance fastener 218 to affix brace structure 220 to the plate 204. FIG. 9 illustrates one operable link element 223 effective to convert a linear displacement from actuator 230 to a rotation of shaft 70. The clevis 223 simply oscillates through a 90 degree arc, with a midpoint of that are being contained in a plane perpendicular to an axis through the input and outlet conduits of valve 35. Of course, alternative and suitable brace structure would be provided if actuator 230 is replaced by a transducer having a rotation displacement.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. In an exhaust-operated brake system for an internal combustion engine, the improvement comprising:

a valve configured for disposition in an enclosed path transmitting an exhaust stream from said engine, said valve being configured to provide substantially restriction-free passage of said exhaust stream through a first passageway, comprising a conduit disposed through a seal member, when said seal member is oriented in a first position, and to provide an increased restriction through a second passageway, to increase a back-pressure in said exhaust stream, operable to resist high-rpm-rotation of said engine while permitting operational rotation of said engine at an idle-speed, when said seal member is rotated into a second position, wherein;

said seal member is configured and arranged such that, at said second position, an axis of said conduit is disposed substantially at right angles to an exhaust stream flow direction at an inlet into said valve, and wherein said valve comprises:

a clamshell housing defining a cavity and third and fourth orthogonal passageways disposed to intersect approximately at a center of said cavity, said third passageway defining said inlet and an outlet for said exhaust, with a first seal surface arranged to circumscribe a junction between said inlet and said cavity;

a said seal member being disposed in said cavity, said seal member being supported between first and second stub axles, said first and second stub axles being disposed for rotation about an axis in common with said fourth passageway to orient a second seal surface, carried by said seal member, in non-contacting harmony with said first seal surface when said seal member is disposed at said second position; and a linkage system arranged to rotate said seal member between said first position and said second position.

2. The improvement of claim 1 further comprising:

an occludable conduit disposed through a wall of said inlet and operable to provide access to measure a back-pressure of said exhaust.

3. The improvement of claim 1, further comprising:

a seal face, circumscribed by said second seal surface, carrying an aperture in fluid communication with said second passageway, said aperture being sized in harmony with a bypass area disposed between said first and said second seal surfaces to permit operational rotation of said engine at an idle-speed of said engine when said seal member is at said second position.

4. The improvement of claim 3, wherein:

said aperture is sized to accommodate a particular size said engine.

5. The improvement of claim 4, wherein:

said seal face is adapted to interface with an assortment of removable plugs, each said plug providing an aperture of a different size; and further comprising a said plug arranged to interface with said seal face.

6. The improvement of claim 1, wherein:

one end of said fourth passageway carries a thimble housing configured as a plug to resist passage of said exhaust through said one end; and an opposite end of said fourth passageway caries an open housing adapted to receive passage therethrough of an axle shaft, with a high temperature o-ring seal being disposed to resist bypass of said exhaust along said axle shaft and through said opposite end.

7. The improvement of claim 6, wherein:

said thimble housing carries a first bushing installed in an interference fit;

said open housing carries a second bushing installed in an interference fit;

said first stub axle holds a third bushing installed in an interference fit;

said second stub axle holds a fourth bushing installed in an interference fit; and said first and said third bushings, and said second and said fourth bushings, are mutually arranged to assemble in a slip-fit arrangement to form a first rotatable bearing between said first and third bushings, and a second rotatable bearing between said second and fourth bushings.

8. The improvement of claim 7, further comprising:

a high-temperature anti-seize lubricant disposed to lubricate said first bearing and said second bearing.

9. The improvement of claim 7, further comprising:

a first thrust washer disposed between a body of said seal member and said first bushing;

a second thrust washer disposed between a body of said seal member and said second bushing; wherein:

said thrust washers are spaced apart in a said valve such that an installed said seal member is permitted an axial play of about 0.035 inches between said first thrust washer and said second thrust washer when measured at an ambient temperature.

10. The improvement of claim 9, wherein:

each of said first, second, third, and fourth bushing is made of hardened steel; and said slip fit is formed by a difference in diameter, between an installed inner bushing and an installed outer bushing, of between about 0.002 inches to about 0.005 inches.

11. The improvement of claim 1, wherein:

said housing and said seal member are formed as metal components having similar coefficients of thermal expansion; and said stub axles are formed as an integral part of said seal member.

12. The improvement of claim 1, wherein:

said clamshell housing comprises interlocking front and rear sections adapted for assembly along an axis approximately parallel to a line drawn between a center of said inlet and a center of said outlet, an abutting flange surface carried by each of said front and rear section providing a datum from which axially to space apart said first seal surface from a rear housing seal surface, a male cylindrical lip carried by one of said front section and said rear section being received in cooperating structure carried in the other of said front section and said rear section operable vertically to align said first seal surface and said rear housing seal surface with respect to said second seal surface and a rear seal surface carried by said sealing member.

13. The improvement of claim 1, further comprising:

an exhaust deflector disposed to protrude inward radially around a discharge end of said inlet effective to increase a pressure drop in an exhaust stream moving between said first seal surface and said second seal surface.

14. The improvement of claim 13, wherein:

said inlet has an inside diameter of about 3.75 inches;

said first seal surface comprises a section of a first sphere having a first diameter of about 5.5 inches, and said second seal surface comprises a section of a second sphere having a second diameter smaller than said first diameter by about 0.04 inches.

15. An exhaust-operated brake for an internal combustion engine, comprising:

a valve adapted to receive an exhaust stream from said engine, said valve being configured to provide substantially insignificant back-pressure to said exhaust stream when a seal member is oriented at a first position, and to provide a restriction operable to increase a back-pressure in said exhaust stream to resist high-rpm-rotation of said engine while permitting operational rotation of said engine at an idle-speed when said seal member is rotated to a second position, said valve comprising:

a housing defining a cavity and first and second orthogonal passageways disposed to intersect approximately at a center of said cavity, said first passageway defining an inlet and an outlet for said exhaust, with a first seal surface configured and arranged to circumscribe a junction between said inlet and said cavity;

said seal member being supported by first and second integral stub axles for rotatable disposition inside said cavity, said first and second stub axles being arranged for rotation about an axis in common with said second passageway to dispose a second seal surface in non-contacting harmony offset from said first seal surface when said seal member is at said second position, a conduit being disposed as a passageway through said seal member with one opening to said conduit being circumscribed by said second seal surface, said conduit being placed into axial congruence with, and disposed between, said inlet and said outlet when said seal member is at said first position; with an exhaust deflector disposed to protrude inward radially around a discharge end of said inlet to increase a pressure drop in an exhaust stream moving between said first seal surface and said second seal surface; and a linkage system arranged to rotate said seal member between said first position and said second position, wherein:

said housing and said seal member are structured and arranged to provide comparable thermally induced expansion operable to avoid contact between said first seal surface and said second seal surface in a range of operating temperatures between ambient temperature and an increased steady-state temperature of said valve resulting from operating said engine.

16. The brake of claim 15, wherein:

said first seal surface is configured as a section of a first spherical surface and said second seal surface is configured as a cooperating section of a second spherical surface of smaller diameter than said first spherical surface.

17. The brake of claim 15, wherein:

a breakover edge is disposed between said second seal surface and a relief area formed in said seal member, said edge being operable to scrape a build-up of exhaust particles from said first seal surface to clean said valve.

18. The brake of claim 15, wherein:

a bearing arrangement for respective first and second stub shafts comprises:

a first bushing installed in an interference fit with structure associated with said second orthogonal passageway of said housing;

a second bushing installed in an interference fit on said respective stub shaft; and said first and said second bushings are mutually arranged to assemble in a slip-fit arrangement to form a rotatable bearing between said first and said second bushings; with:

a high-temperature anti-seize lubricant disposed between said first and second bushings.

19. The brake of claim 15, further comprising:

a seal face, bounded by said second seal surface, said seal face carrying an aperture in fluid communication with said conduit, said aperture being sized in harmony with an exhaust bypass area between said first and second seal surfaces to permit operational rotation of said engine at an idle-speed of said engine.

* * * * *